US008108955B2

(12) United States Patent
Yu

(10) Patent No.: US 8,108,955 B2
(45) Date of Patent: Feb. 7, 2012

(54) MOTOR-AND-NOZZLE COMBINATIONAL APPARATUS FOR A MASSAGE BATHTUB

(75) Inventor: Li-Fu Yu, Taipei (TW)

(73) Assignee: Egis Bathware Development Co., Ltd, Yilan, Yilan County (TW)

( * ) Notice: Subject to any disclaimer, the term of this patent is extended or adjusted under 35 U.S.C. 154(b) by 650 days.

(21) Appl. No.: 12/253,231

(22) Filed: Oct. 16, 2008

(65) Prior Publication Data

US 2010/0095449 A1 Apr. 22, 2010

(51) Int. Cl.
*A61H 33/00* (2006.01)

(52) U.S. Cl. ..... 4/541.6; 4/541.5; 4/492

(58) Field of Classification Search ..... 4/541.1, 4/541.2, 541.3, 541.4, 541.5, 541.6, 492
See application file for complete search history.

(56) References Cited

U.S. PATENT DOCUMENTS 6,322,004 B1 * 11/2001 Perdreau et al. ..... 239/428.5
6,470,509 B1 * 10/2002 Ayeni ..... 4/541.6
6,991,182 B2 * 1/2006 Chen ..... 239/251
7,108,202 B1 * 9/2006 Chang ..... 239/380
7,143,456 B2 * 12/2006 Woeste ..... 4/541.6
7,150,051 B2 * 12/2006 Schlief ..... 4/541.6
7,574,756 B2 * 8/2009 Tran ..... 4/541.6
2008/0010735 A1 * 1/2008 Hillyard ..... 4/492
2008/0066224 A1 * 3/2008 Wooten ..... 4/541.5
2008/0086810 A1 * 4/2008 Le ..... 4/541.6
2009/0094736 A1 * 4/2009 Booth et al. ..... 4/541.6

* cited by examiner

*Primary Examiner* — Brian Glessner
*Assistant Examiner* — Beth Stephan

(57) ABSTRACT

A motor with nozzle for a massage bathtub includes a cover, a silica gel ring, a water separator, at least one vent silica gel, at least one removable nozzle, a butterfly bolt, a propeller, a seat, and a motor. The seat is installed by an air inflow pipe, and air outlets and lamp holes are formed therein. A center axle of the motor is scaled from water and a connecting hole is formed on an end of the center axle. The butterfly bolt is screwed to the connecting hole to fix the propeller. The water separator is installed above the propeller and the vent silica gel and the removable nozzle are installed to the water separator. The cover is covered onto the seat of a motor body through the silica gel ring.

5 Claims, 12 Drawing Sheets

MOTOR-AND-NOZZLE COMBINATIONAL APPARATUS FOR A MASSAGE BATHTUB

FIELD OF THE PRESENT INVENTION

The present invention relates to motors, and in particular to a motor-and-nozzle combinational apparatus for a massage bathtub without any prior used pipe, easy to clean, and with lighting effects. It is easy to be installed to an inner wall of a bathtub. Water is sucked into and pressurized by the motor and by a siphonic effect of the nozzle, bubbles mixed with water column is thus formed and spouted out.

DESCRIPTION OF THE PRIOR ART

With the advance of modern technologies, bathtubs with functions of hydropathy and massage are popular among people. As shown in FIGS. 1 and 2, a meshed inlet 11 and a plurality of nozzles 13 are installed on an inner wall of a bathtub. A motor 14 is installed within the bathtub and is connected to the meshed inlet 11 through a water return piping 12, and is connected to the nozzles 13 through a water supply piping 18. Thus, when a switch 141 of the motor is turned on, water B being drained from the meshed inlet 11 will spout out from the nozzles 13 through outlet 131 of the water supply piping 18. Each nozzle 13 is further linked with an air piping 17. Referring to FIG. 3, air is guided into the bathtub body 1 by siphonic effect and water B is formed as water column mixed with bubbles around each nozzle 13. A regulator 15 is arranged to the air piping 17 to adjust air flow so as to control the intensity of water column.

However, a common defect of the prior massage bathtub is that the structure of the piping is more complicated than that of a normal bathtub. Because water returned from the water return piping 12, hairs and soap residues are remained in the pipe between the nozzles 13 as shown in FIG. 2. Smells, even worms and germs are easily caused in such circumstance. Dirt is returned into bathtub with the clean water every time, but the user does not keep attention to this state, as a result the user's health is damaged by the corrupted water. Thus, the inventor of the present invention hopes to solve above mentioned defects.

SUMMARY OF THE PRESENT INVENTION

Accordingly, the primary object of the present invention is to provide a motor-and-nozzle combinational apparatus for a massage bathtub without any complex piping installed inside the bathtub, easy to remove, clean and install, and with function of lighting, also has the effect of bubble spouts and thus the user feel funny in bath.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
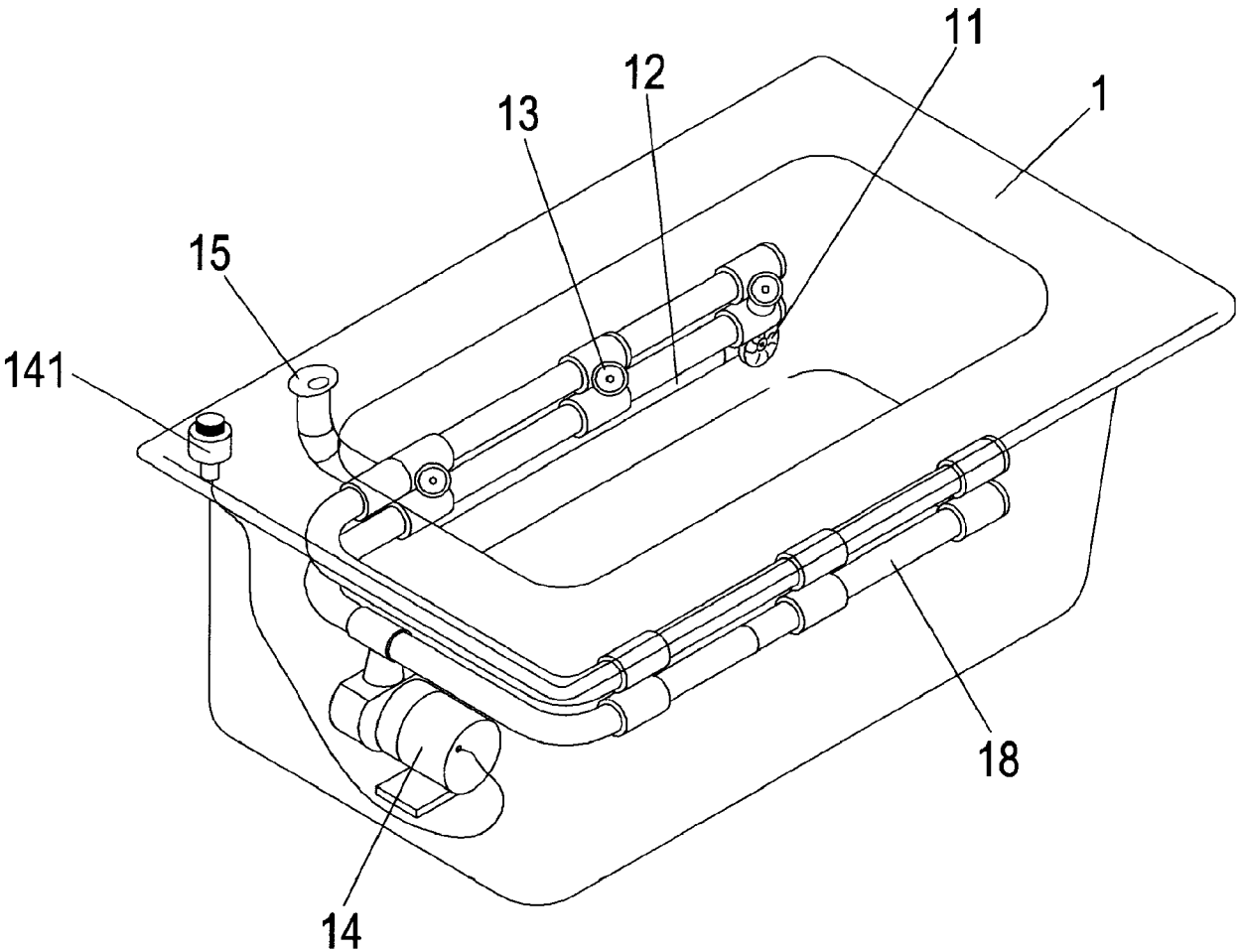
Fig. 1 Prior Art
FIG. 1 is a schematic view showing the piping of a prior massage bathtub.
Figure 2:
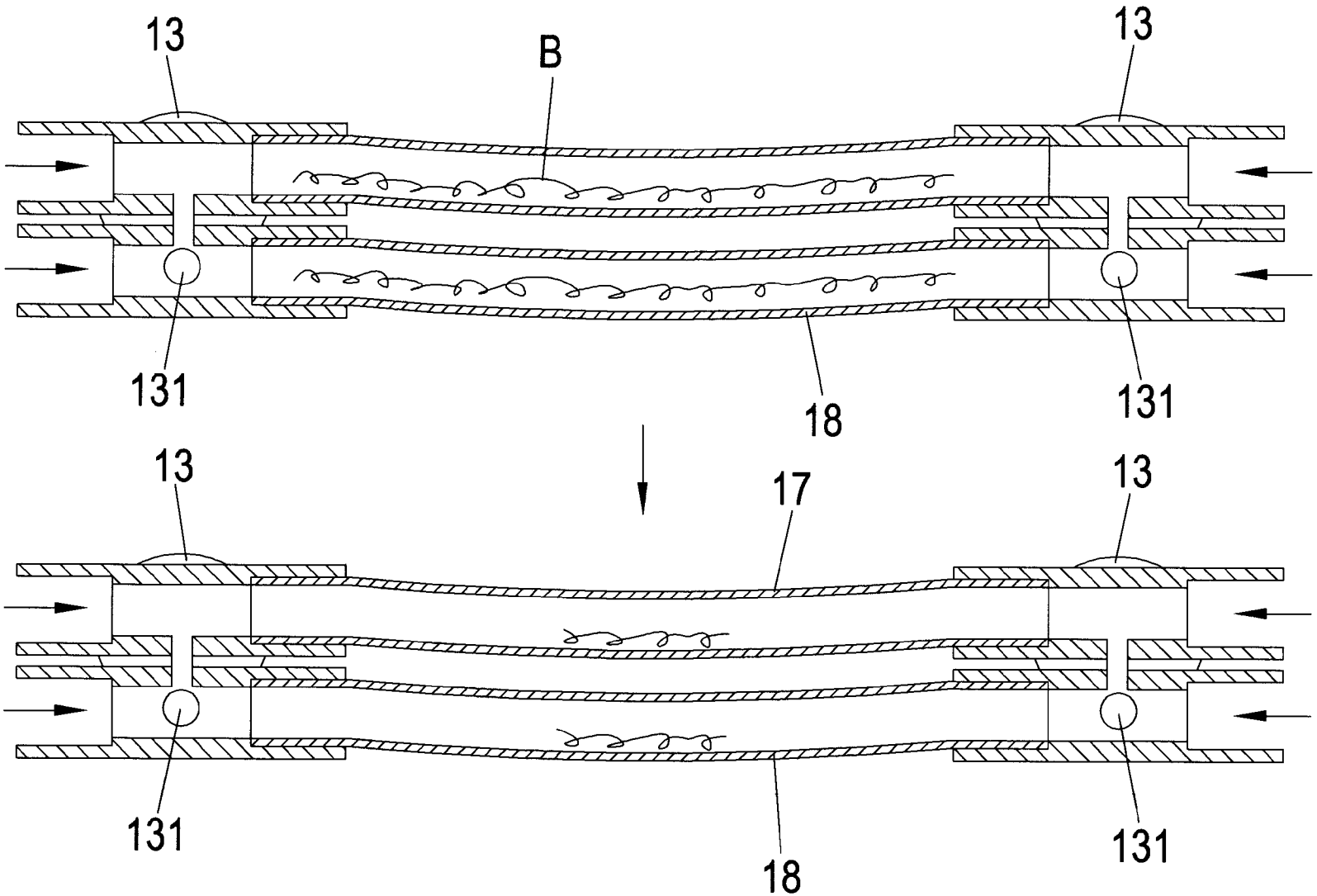
FIG. 2 is a cross section view showing dirt remained in a prior piping of a bathtub.
Figure 3:
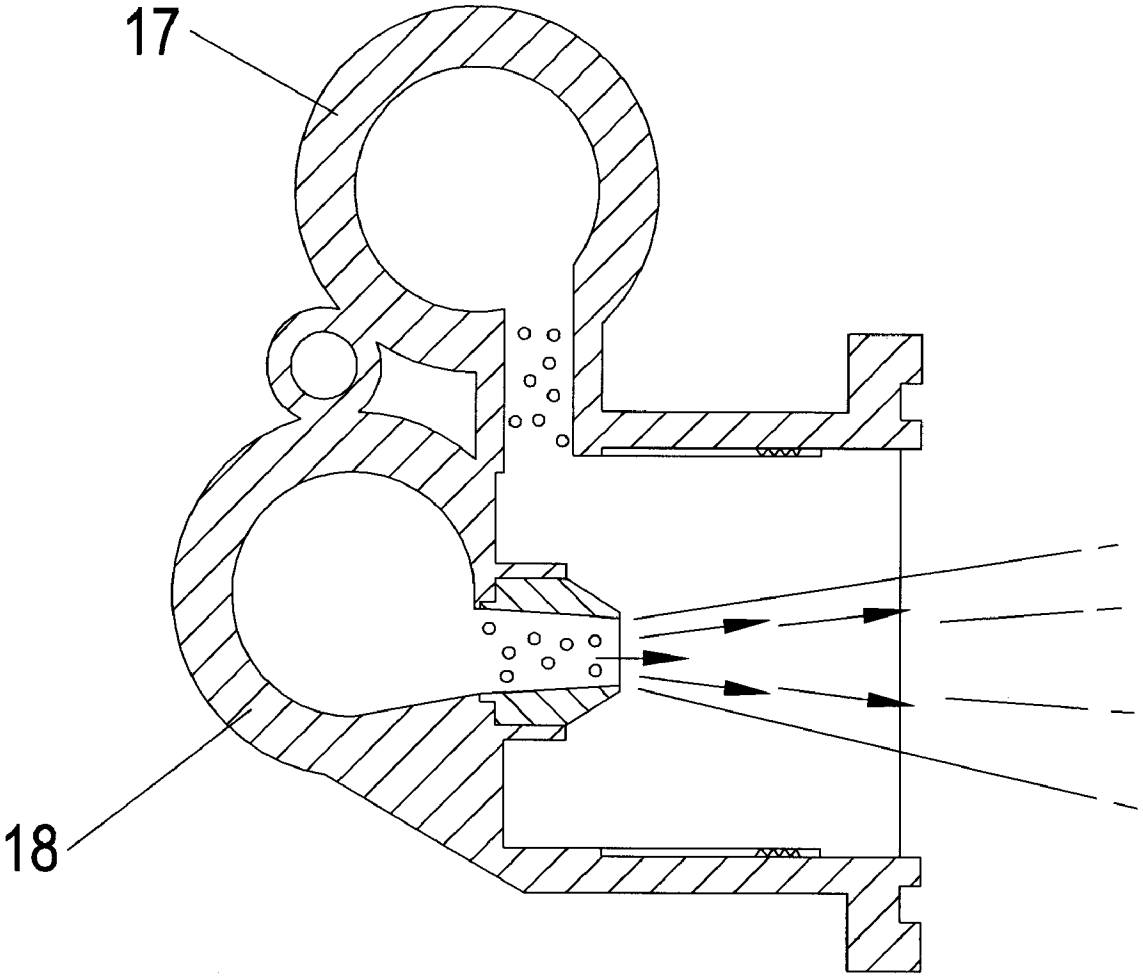
FIG. 3 is a cross section view showing a prior piping and nozzle.
Figure 4:
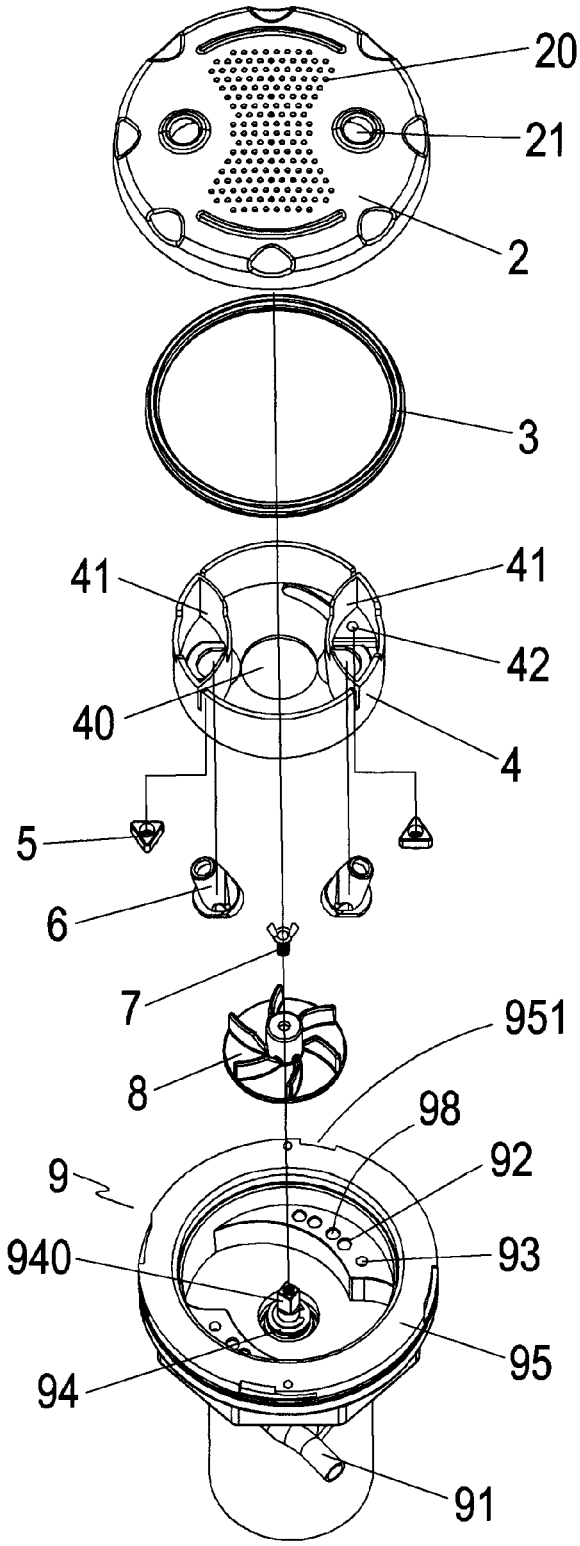
FIG. 4 is an exploded drawing of the present invention.
Figure 5:
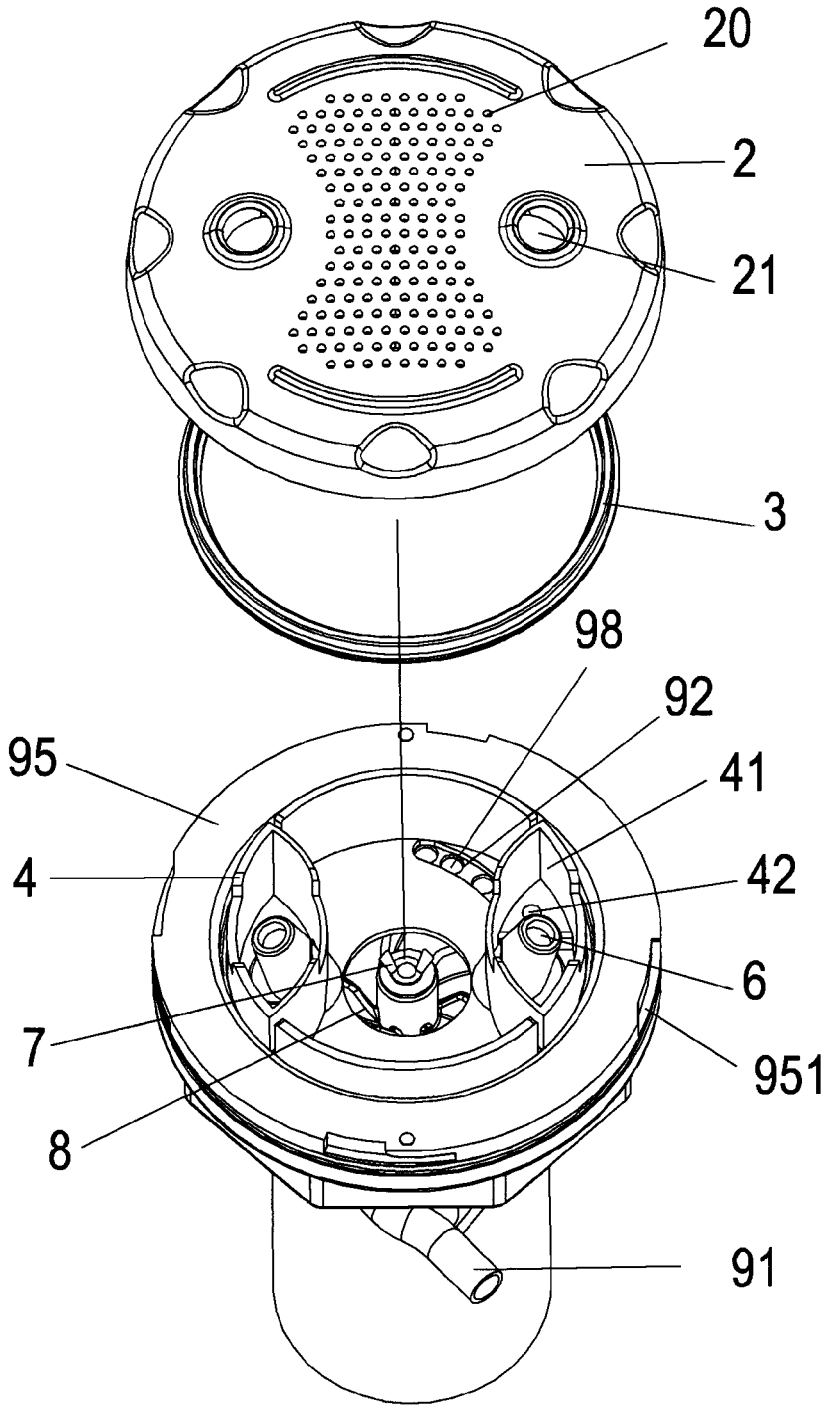
FIG. 5 is a partial exploded drawing of the present invention.
Figure 11:
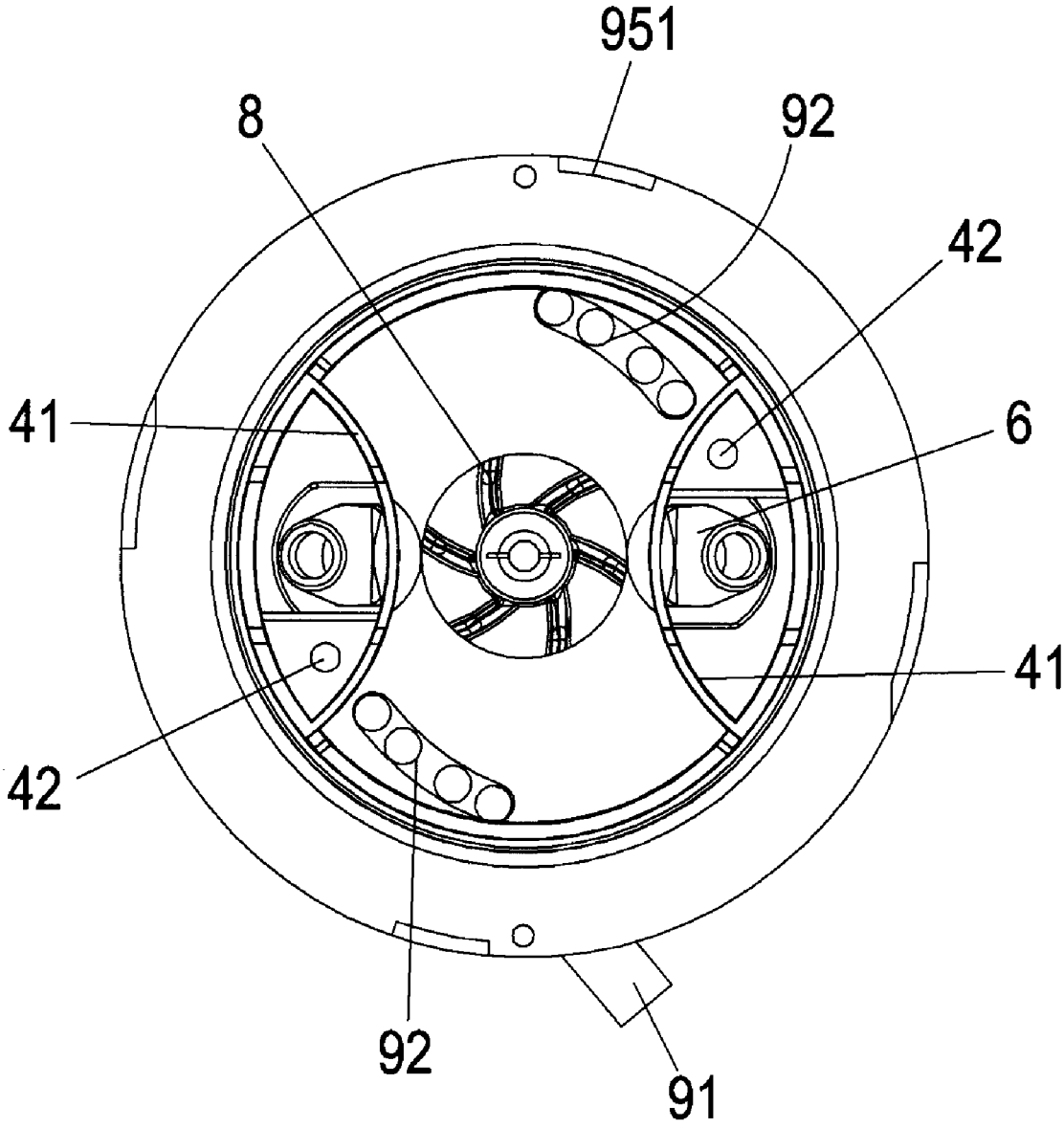
FIG. 11 is a schematic view of the present invention showing from a top side.

Referring to FIGS. 4, 5, and 11, a motor with nozzle for a massage bathtub according to the present invention includes a cover 2, a silica gel ring 3, a water separator 4, at least one vent silica gel 5, at least one removable nozzle 6, a butterfly bolt 7, a propeller 8, and a motor body 9. The cover 2 is formed with a plurality of water inlets 20 and two water spouts 21. An air inflow pipe 91 is installed to the motor body 9, a plurality of lamp holes 92 and air outlets 93 are formed inside the motor body 9. A center axle 94 of the motor body 9 is installed to prevent water from flowing into the motor and a connecting hole 940 is formed in one end of the center axle 94. The butterfly bolt 7 is screwed into the connecting hole 940 axially so as to fix the propeller 8. The water separator 4 having a water inlet 40 in a center thereof is installed above the propeller 8. Separating walls 41 are formed on two opposite sides of the water separator 4, and each separating wall 41 and a part of a peripheral wall of the water separator 4 are formed with a room. One of the two rooms is installed with an air outlet 42 and another is formed with a nozzle 6. The vent silica gel 5 is arranged between the bottom opening of the air outlet 42 and the air outlet 93 so as to have a gastight connection to prevent water from flowing to the water separator. The cover 2 covers a seat 95 on a top of the motor body 9 with the silica gel ring 3 installed therebetween. The silica gel ring 3 can prevent pressure reduction of the motor after the pressure of the motor is increased so that the propeller 8 can generate high pressure water jet. A slot 951 is formed on the seat 95 and a corresponding notch capable of fitting to the slot 951 is formed on an edge of the cover 2.

Figure 6:
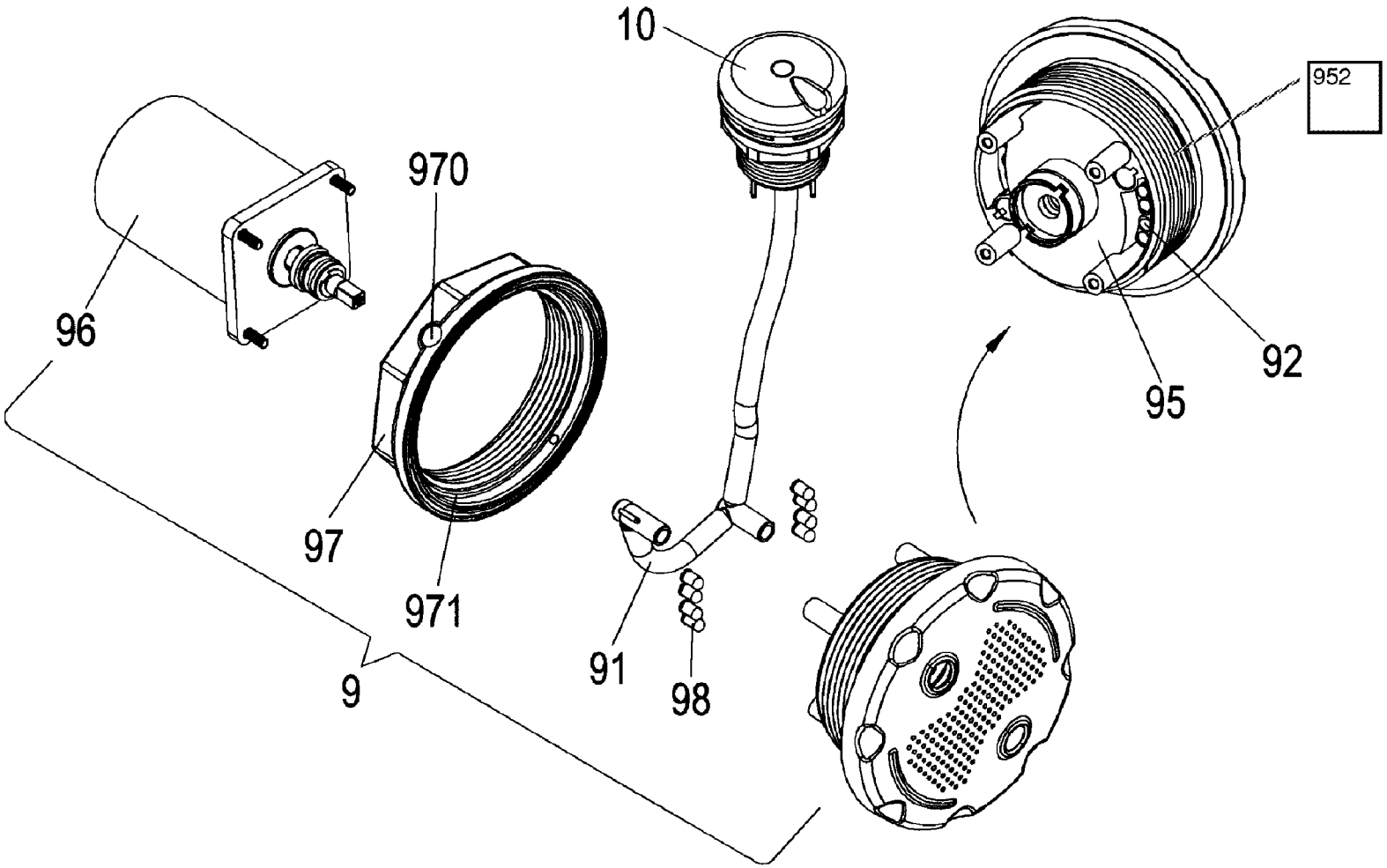
FIG. 6 is an exploded drawing of a motor body of the present invention.
Figure 8:
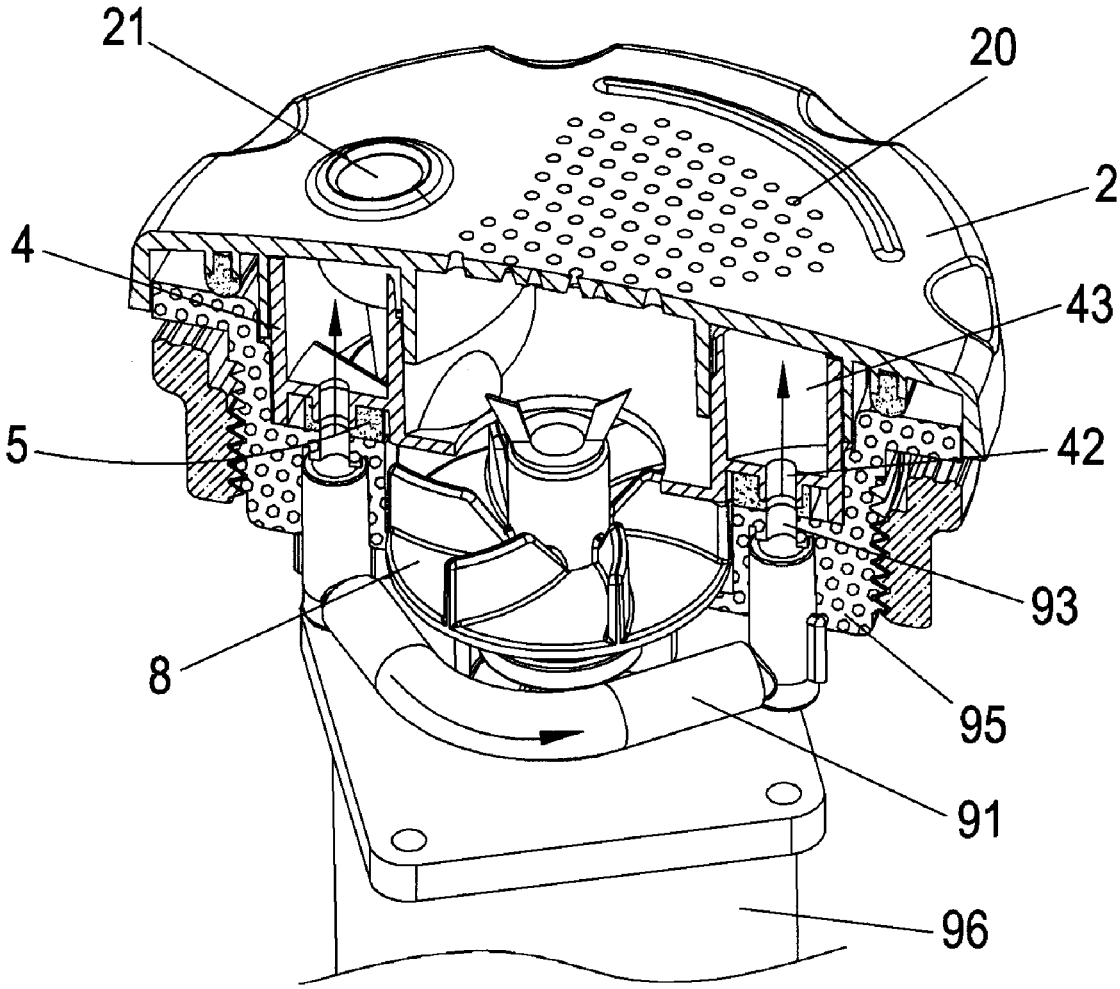
FIG. 8 is a schematic view showing gas flow of the present invention.
Figure 10:
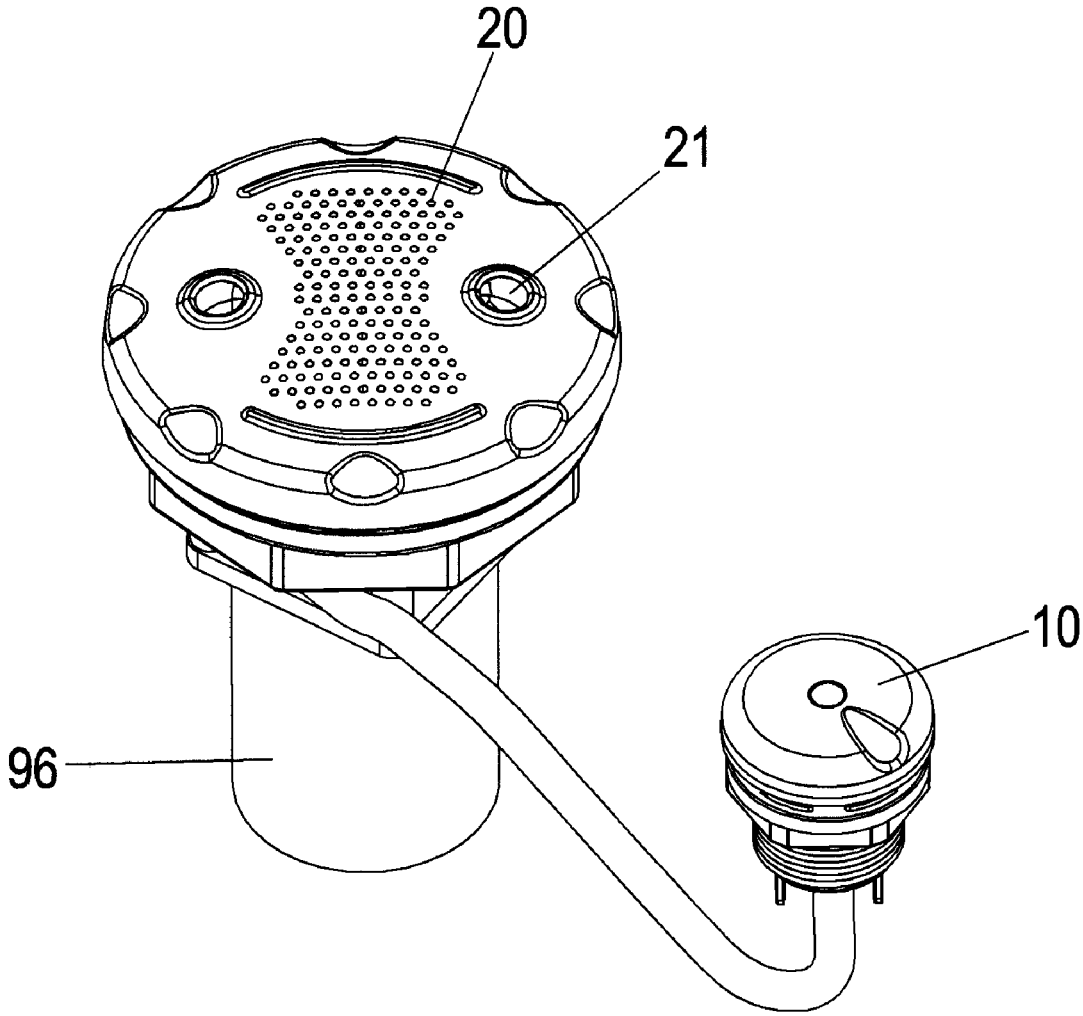
FIG. 10 is a schematic view of a preferable embodiment of the present invention.

With reference to FIGS. 6, 8, 10, a motor 96, the air inflow pipe 91, a sheath ring 97, the seat 95, and a plurality of LEDs 98 of the motor body 9 according to the present invention are illustrated. The sheath ring 97 has a gel injecting hole 970 for injecting gel to bind the sheath ring 97 and the seat 95 to a wall of a bathtub. The sheath ring 97 has an inner thread 971 for fitting an outer thread of the seat 95. The air inflow pipe 91 is connected to the air outlet 93 of the seat 95 and the air outlet 42 through the vent silica gel 5. The LEDs 98 are installed into the lamp holes 92 of the seat 95. The seat 95 is fixed to the motor 96 by bolts. The air inflow pipe 91 can be arranged with a regulator 10 to adjust air flow so as to adjust the amount of the bubbles spouted out.

Figure 7:
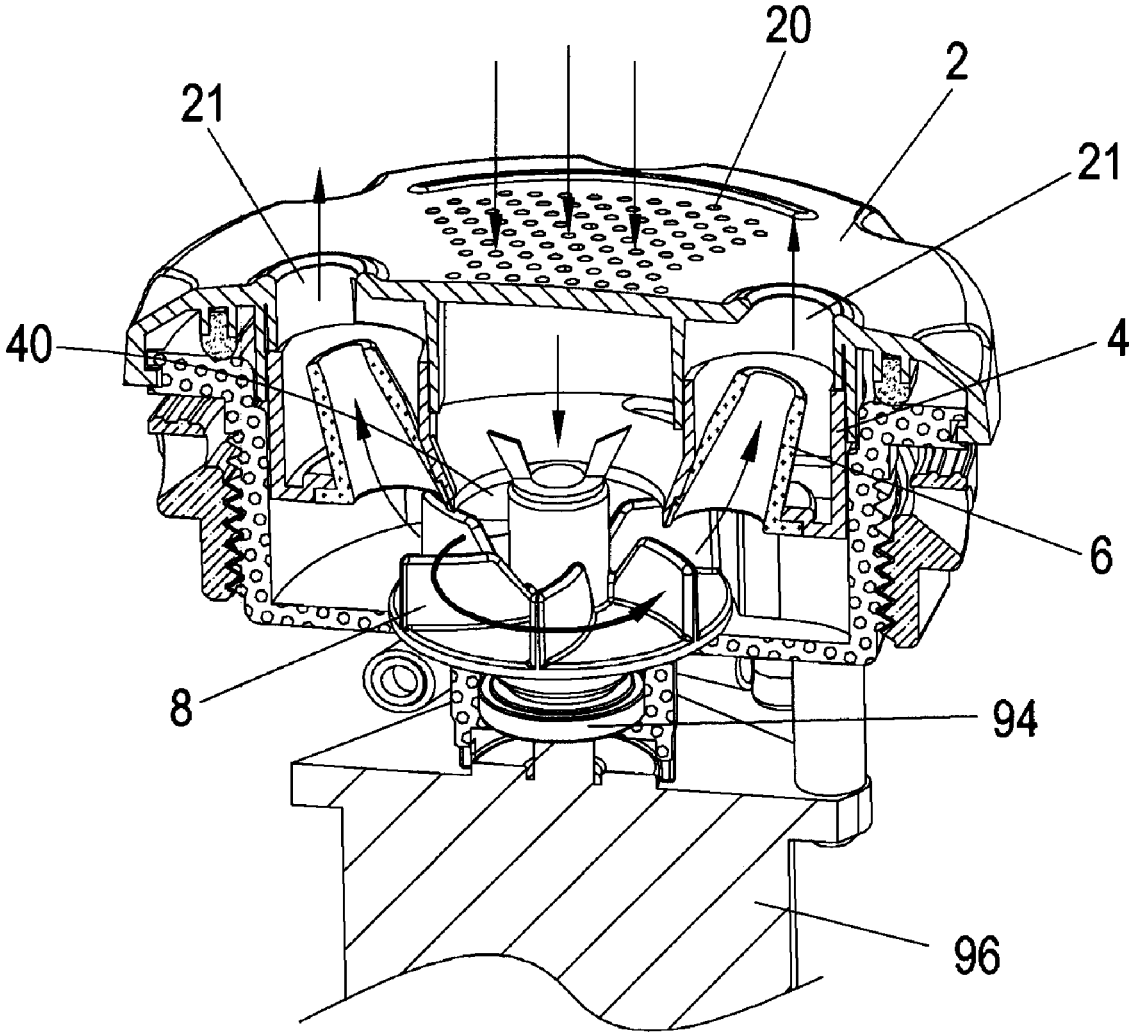
FIG. 7 is a schematic view showing water flow of the present invention.

Referring to FIG. 7, the propeller 8 is rotated by driving of the center axle 94 by the motor 96. The suction generated by the rotation of the propeller 8 absorbs water from the water inlets 20 of the cover 2, the water will pass through water inlets 40 of the water separator 4 and is spouted out from the water spouts 21 through the removable nozzles 6 by the pressurization of the rotating propeller 8.

Figure 9:
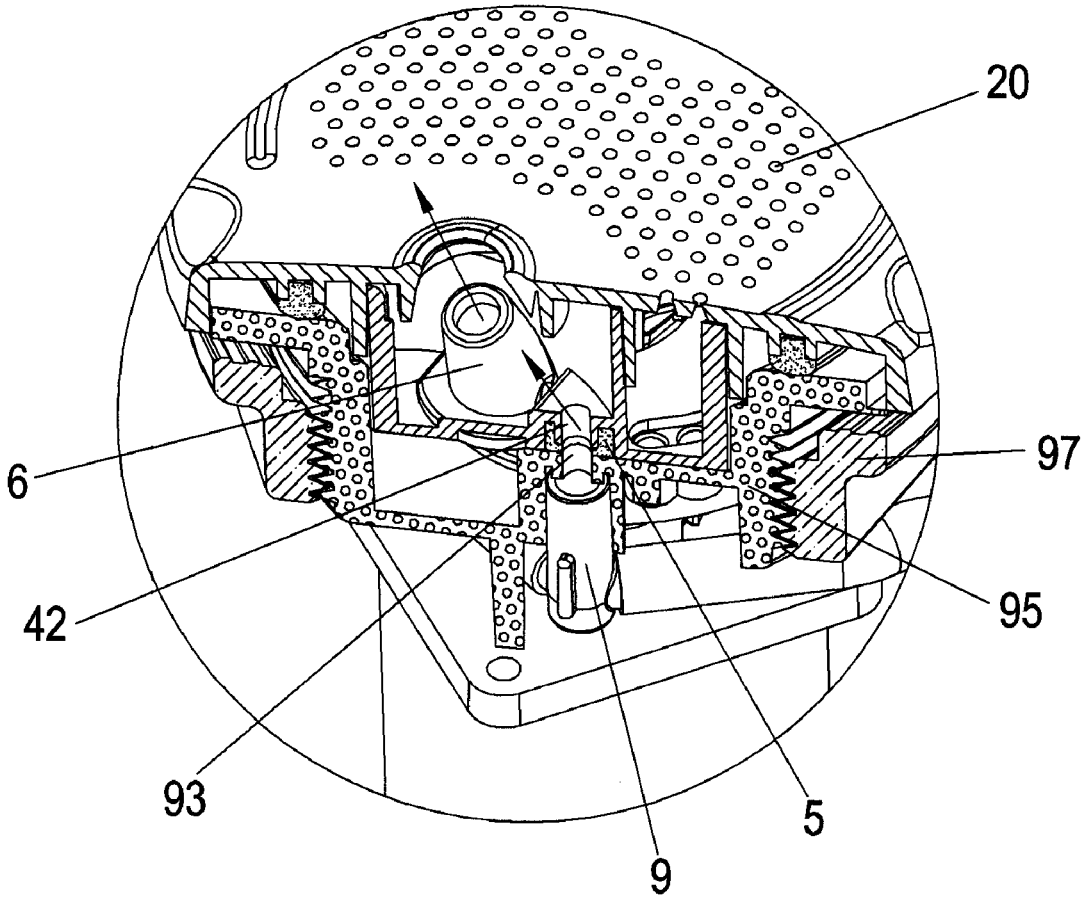
FIG. 9 is a partial enlarged schematic view of the present invention.

With reference to FIGS. 8 and 9, by siphonic effect caused by a strong water spout of the removable nozzle, air from the air inflow pipe 91 will be sucked into a receiving space 43 of the water separator 4 through air outlet 93 of the seat 95 and the air outlet 42 of the water separator 4. Water columns mixed with bubbles are thus formed and spout out from the water spout 21.

Figure 12:
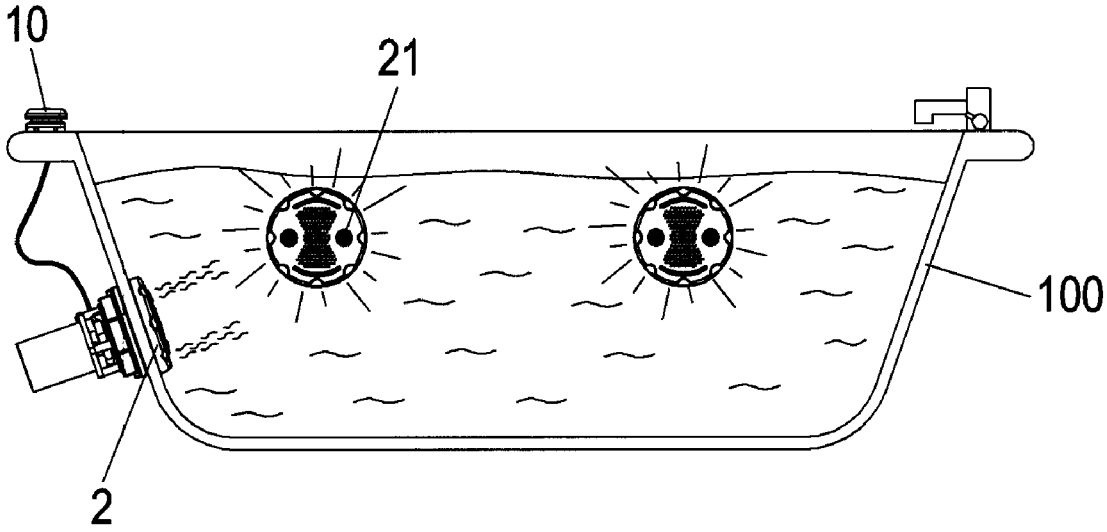
FIG. 12 is another schematic view of a preferable embodiment of the present invention.

Referring to FIGS. 6 and 12, the motor body 9 is installed to a preserved hole on a wall 100 of a bathtub by the locking of the sheath ring 97 and the seat 95. A regulator 10 is linked to the air inflow pipe 91 of the motor body 9. Water columns with bubbles spouted out from the water spouts 21 of the cover 2 with the lighting effect of the LEDs are helpful to the washing.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A motor-and-nozzle combinational apparatus for a massage bathtub, the apparatus comprising a cover, a silica gel ring, a water separator, at least one vent silica gel, at least one removable nozzle, a butterfly bolt, a propeller, and a motor body; the motor body further having a motor, an air inflow pipe, a sheath ring, a seat, and a plurality of light emitting diodes; the sheath ring having an inner thread being screwed to an outer thread of the seat; the air inflow pipe being inserted into an air outlet of the seat; the diodes being installed to a plurality of lamp holes in the seat; the seat being fixed to the motor by bolts; a center axle of the motor being sealed from water and a connecting hole being formed on an end of the center axle; the butterfly bolt being screwed to the connecting hole to fix the propeller; the water separator being installed above the propeller and the vent silica gel and the removable nozzle being installed to the water separator; the cover being covered onto the seat of the motor body through the silica gel ring.

2. The motor-and-nozzle combinational apparatus for a massage bathtub as claimed in claim 1, wherein the sheath ring has a gel injecting hole.

3. The motor-and-nozzle combinational apparatus for a massage bathtub as claimed in claim 1, wherein the cover is formed as meshed water inlets and water spouts.

4. The motor-and-nozzle combinational apparatus for a massage bathtub as claimed in claim 1, wherein the water separator has a water inlet at a center thereof; ring separating walls are formed on two sides inside the water separator; each separating wall defines a receiving space with a lateral wall of the water separator.

5. The motor-and-nozzle combinational apparatus for a massage bathtub as claimed in claim 1, wherein the motor body is installed to an inner wall of a bathtub and a regulator is linked to the air inflow pipe of the motor body; water being sucked through the water inlets of the cover is pressurized by the motor and by a siphonic effect of the nozzle, bubbles mixed with water columns is thus formed and spouted out.

* * * * *